United States Patent [19]

Seehawer

[11] Patent Number: 4,513,564

[45] Date of Patent: Apr. 30, 1985

[54] YARN

[76] Inventor: Magda Seehawer, Sonnhalde 9, 7400 Tübingen 1, Fed. Rep. of Germany

[21] Appl. No.: 580,545

[22] Filed: Feb. 15, 1984

[30] Foreign Application Priority Data

Jun. 18, 1983 [DE] Fed. Rep. of Germany ... 8317790[U]

[51] Int. Cl.[3] ..... A41G 9/00; D02G 3/00

[52] U.S. Cl. ..... 57/206; 57/200; 57/203; 57/209; 428/6

[58] Field of Search ..... 428/6; 24/447; 57/200, 57/203, 206, 209

[56] References Cited

U.S. PATENT DOCUMENTS

| | | | |
|---|---|---|---|
| 709,621 | 9/1902 | Warren et al. | 57/200 X |
| 709,622 | 9/1902 | Warren et al. | 57/200 X |
| 1,005,959 | 10/1911 | DeGrandmont | 428/6 |
| 2,365,502 | 12/1944 | Weesner | 428/6 X |
| 2,699,009 | 1/1955 | Wagner | 43/42.25 |
| 3,913,183 | 10/1975 | Brumlik | 24/447 |
| 4,259,400 | 3/1981 | Bolliand | 428/6 X |
| 4,259,790 | 4/1981 | Borisof | 428/187 X |

*Primary Examiner*—Henry F. Epstein
*Attorney, Agent, or Firm*—Michael J. Striker

[57] ABSTRACT

A yarn comprised of a number of threads twisted with each other is provided with a plurality of feathers, the quill portions of which are tightly inserted into twisted threads and the feather portions of which project outwardly from the twisted threads to form a bird feather-shaped covering of the yarn.

10 Claims, 1 Drawing Figure

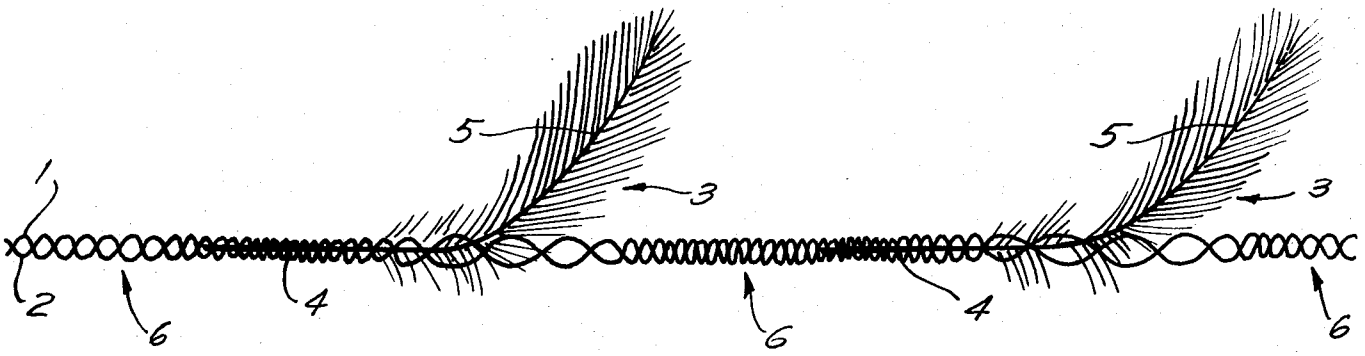
1
2
3
4
5
6

YARN

BACKGROUND OF THE INVENTION

The present invention relates to a yarn which is comprised of at least two twisted individual threads Yarns formed of a number of individual threads have been known in the art. Individual threads utilized in yarns can comprise synthetic plastic or natural fibers which are twisted together.

SUMMARY OF THE INVENTION

It is an object of the present invention to provide an improved yarn which is covered with a soft, fleecy material.

This and other objects of the invention are attained by a yarn, comprising at least two individual threads twisted with one another, and a plurality of feathers having quill portions and feather portions and inserted into said twisted threads at intervals from each other so that the quill portions of the feathers are fully inserted into the threads and the feather portions thereof project outwardly from the threads. The feathers have the form of bird feathers Therefore, feather formations of the yarn can be obtained with feathers twisted with the yarn.

According to another feature of the invention the twists of the threads in the regions of the quill portions of the feathers inserted into the yarn are tighter than the twists of the threads in the remaining regions of the yarn.

The inserted feathers thereby have rigid seats in the yarn.

Furthermore, the number of twists of the threads per a length unit in the regions of the feather portions may be smaller than that in the remaining regions of the yarn. Thereby, a spreading of the feather portions in the outward direction from the elongation of the yarn is not precluded.

Particularly rigid seats for the feathers inserted into the yarn can be obtained if the ends of the quill portions are bent and twisted with the threads. This ensures that a relatively hard quill portion of the feather does not project outwardly from the yarn.

It is advantageous that natural chicken or goose feathers can be utilized to produce the yarn according to the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing schematically shows a yarn structure according to the invention.

DETAILED DESCRIPTION OF THE PREFERRED EMBODIMENT

The yarn shown in the sole FIGURE of the drawing is comprised of two twisted individual threads 1 and 2 which are supplied at equal intervals with feathers 3. Each feather includes a quill portion 4 and a feather portion 5. The quill portion 4 is inserted into twisted threads 1 and 2 and, as shown in the drawing, threads 1 and 2 are wound around the quill portion of the feather particularly tightly. The yarn in this region includes a specially high number of twists per length unit.

In the region of feather portion 5 which protrudes outwardly from the yarn the latter has a substantially smaller number of twists so that the twists do not preclude feather portion 5 from spreading outward from the yarn threads.

In the remaining parts of the yarn, designated by reference numeral 6, the yarn has a middle number of twists, which lies between the number of twists in the region of the quill portion of and the number of twists in the region of the feather portion 5.

Two individual threads 1, 2 are utilized in the exemplified embodiment of the invention. It is, however, understandable that more than two threads can be twisted together and fed with feathers inserted into the twisted threads at certain intervals from each other. It is to be noted that instead of genuine bird feathers synthetic feathers can be used for manufacturing the yarn according to the invention. These synthetic feathe can be made for example, from synthetic or natural feathers.

The drawing shows a simplified structure formed of two twisted individual threads. The number of twists in the region of quill portion 4 is sufficiently great that threads 1 and 2 entirely overlap and cover the quill portion. Due to such an enclosed quill portion 4 an insignificant thickening of the twisted yarn results in this region. The end of each quill portion of each feather can be bent and twisted so as to not extend outwardly from the threads of the yarn. A particularly high-quality feather yarn can be obtained when threads of pure silk are utilized.

It will be understood that each of the elements described above, or two or more together, may also find a useful application in other types of yarns differing from the types described above.

While the invention has been illustrated and described as embodied in a yarn, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A yarn, comprising at least two individual threads twisted with one another along their entire length, and a plurality of feathers having quill portions and feather portions and inserted into said twisted threads at predetermined intervals from each other and such that the quill portions of the feathers are fully inserted into the twisted threads and the feather portions thereof project outwardly from the threads to form a fleecy feather yarn.

2. The yarn as defined in claim 1, wherein said feathers have the form of bird feathers.

3. The yarn as defined in claim 1, wherein the twists of the threads in the regions of the quill portions of the feather inserted into the yarn are tighter than the twists of the threads in remaining regions of the yarn.

4. The yarn as defined in claim 3, wherein the number of twists of the threads per a length unit in the regions of the feather portions is smaller than that in the remaining regions of the yarn.

5. The yarn as defined in claim 4, wherein the number of the twists of the threads per a length unit in the regions of the quill portions of the feathers is at least three times greater than that in the regions of the feather portions.

6. The yarn as defined in claim 5, wherein the quill portions each has. an end,the ends of the quill portions being bent and twisted with the threads.

7. The yarn as defined in claim 2, wherein bird feathers are utilized as said feathers.

8. The yarn as defined in claim 7, wherein said bird feathers are chicken feathers.

9. The yarn as defined in claim 7, wherein said bird feathers are goose feathers.

10. The yarn as defined in claim 1, wherein said feathers are spaced from each other at equal intervals along the twisted threads.

* * * * *